United States Patent [19]

Hollstein et al.

[11] 4,380,320

[45] Apr. 19, 1983

[54] ELECTROSTATIC POWDER SPRAY GUN NOZZLE

[75] Inventors: Thomas E. Hollstein, Amherst; Ronald J. Hartle, Lorain, both of Ohio

[73] Assignee: Nordson Corporation, Amherst, Ohio

[21] Appl. No.: 238,115

[22] Filed: Feb. 25, 1981

[51] Int. Cl.[3] ..... B05B 5/04

[52] U.S. Cl. ..... 239/697; 239/704; 239/290; 239/590

[58] Field of Search ..... 239/3, 690, 696–698, 239/704–708, 290, 300, 426, 500, 524, 590

[56] References Cited

U.S. PATENT DOCUMENTS

| | | | |
|---|---|---|---|
| 3,448,925 | 6/1969 | Cross | 239/698 |
| 3,659,151 | 4/1972 | Fabre | 239/3 |
| 3,667,675 | 6/1972 | Sherman et al. . | |
| 3,688,990 | 9/1972 | Liedberg . | |
| 3,740,612 | 6/1973 | Gauthier | 239/706 X |
| 3,819,115 | 6/1974 | Soderman | 239/698 |

FOREIGN PATENT DOCUMENTS

| | | |
|---|---|---|
| 2312363 | 9/1973 | Fed. Rep. of Germany . |
| 1236664 | 6/1971 | United Kingdom . |
| 1241593 | 8/1971 | United Kingdom . |
| 2053029 | 4/1981 | United Kingdom . |

OTHER PUBLICATIONS

Technical Publication 31-4-0, "Manual 31-4, Electrostatic Powder Spray Hand Gun, Model NPE-2M ", Nordson Corporation.

*Primary Examiner*—Andres Kashnikow

*Attorney, Agent, or Firm*—Wood, Herron & Evans

[57] ABSTRACT

A nozzle assembly for an electrostatic powder spray gun is disclosed. The powder spray gun includes an electrically non-conductive barrel through which a high voltage electrical path passes. The nozzle assembly is mounted in the open forward end of the barrel and includes a sleeve located on the center axis of the barrel for directing a flow of a pressurized gas, e.g., air, through the center of the nozzle assembly, a nozzle surrounding the sleeve defining an annular flow path for powder spray coating material encircling the flow of pressurized air and an air deflector cap for directing the pressurized air radially outwardly and into the flow of powder spray coating material being emitted from the nozzle. The air impacts the powder coating material to form a conical spray pattern of coating material. The gun also includes an electrode extending out of the nozzle assembly for electrostatically charging the powder. The nozzle assembly eliminates mechanical powder deflectors and the problems attendant therewith.

6 Claims, 4 Drawing Figures

ELECTROSTATIC POWDER SPRAY GUN NOZZLE

BACKGROUND OF THE INVENTION

This invention relates to electrostatic spray coating, and, more particularly, to a nozzle for a powder spray gun which does not require a mechanical powder deflector. In the application of powder coating material to objects in industrial finishing applications, a powder material such as an epoxy, polyester, or porcelain frit is conveyed to an applicator gun by air under pressure, is dispensed from the gun in the form of a spray, and is projected toward the object to be coated in particulate form. As the coating material is dispensed from the gun, the particles are imparted with an electrical charge so that they will be electrostatically attracted toward the object to be coated which is held at electrically ground potential. After coating, the object may be moved into an oven where the powder coating material is baked onto the surface. The material being dispensed from the gun is in particulate form and it is necessary to direct the material in a broadened spray pattern to obtain uniform, smooth and wide coverage of the surface of the object to be coated.

In known electrostatic powder spray guns, a mechanical deflector is mounted at the nozzle end of the gun. The deflector extends into the flow of powder being emitted from the gun and deflects the powder into a conical spray pattern. That is, the deflector is impacted by the powder coating material being emitted from the gun and directs the powder radially outwardly to form a conical spray pattern. As stated above, however, the powder is in particulate form and is characteristically quite abrasive on the parts of the gun impacted by the powder. Moreover, the powder is carried by air under pressure; and, as a result, the effect of the powder on the nozzle parts is much like sandblasting. As a result, mechanical deflectors are subject to rapid wear even though they may be formed of a hard material such as a ceramic. Another problem associated with mechanical deflectors is that the powder impinging on the deflector tends to build up on the surface thereof. After a given amount of buildup, a clump of coating material can drop off and hit the workpiece thereby marring the finish. This is particularly true when the gun is mounted overhead of the workpiece.

SUMMARY OF THE INVENTION

It has been among the principal objects of this invention to provide an improved nozzle for an electrostatic spray gun which does not require a mechanical deflector to form the conical spray pattern of powder spray coating material.

It has been a further objective of this invention to provide such an improved nozzle for an electrostatic spray gun which provides for uniform, fine atomization of the powder coating material and which prevents buildup of powder on the front of the gun.

It has been another objective of this invention to provide an electrostatic spray gun which permits remote adjustment of the powder spray pattern by the operator.

It has been a still further objective of this invention to provide such an improved nozzle for an electrostatic spray gun which is compact, simple in construction, and easy to manufacture, maintain and repair.

These and other objects of this invention are achieved by providing an improved nozzle for an electrostatic spray gun having a new and unique combination of components eliminating the need for any mechanical powder deflector to form the conical spray pattern. In accordance with a presently preferred form of the invention, the powder spray gun includes a barrel portion having a high voltage electrical path in it and a nozzle assembly mounted in the forward open end of the barrel portion. The nozzle assembly and barrel are made of a substantially non-conductive material such as a dielectric plastic. The barrel has openings in the wall thereof to be connected to a source of pressurized gas such as air and a source of fluidized powder coating material from a bulk powder source. The nozzle assembly is substantially axially aligned with the barrel portion of the gun and includes a sleeve mounted in the center of the barrel with the long axis of the sleeve lying on the center axis of the barrel. The sleeve is open at both its forward and its rearward end and communicates at its rearward end with the source of pressurized air entering through the wall of the barrel. The pressurized air flows along the inside of the sleeve forming a generally central axial flow of air and then out of the open forward end of the sleeve in the form of an annulus. A nozzle is mounted in the forward open end of the barrel surrounding the sleeve and defines with the sleeve a generally annular flow path for the powder coating material which path surrounds or encircles the flow path of the pressurized air. A gas deflector cap is mounted at the forward open end of the sleeve spaced slightly forwardly of that end. The pressurized air issuing out of the forward end of the sleeve impacts the cap and is deflected in a radially outward direction. The outwardly flowing deflected air under pressure then impacts the powder being emitted from the nozzle to atomize it and direct the powder into a conical spray pattern. An electrode extends down the center of the sleeve and out the forward end of the nozzle assembly. This electrode is connected at its rearward end to the high voltage electrical path in the barrel of the gun and is operative to electrostatically charge the powder particles being emitted from the gun.

In operation, the fluidized powder coating material enters through the wall of the barrel of the gun and flows in a generally annular pattern out the forward end of the nozzle. The pressurized deflecting air flows out the center of the nozzle assembly where it impacts on the deflecting cap. The cap directs the deflecting air in a radially outward direction. The now deflected air moving radially outwardly impacts on the powder coating material being emitted from the nozzle assembly to form the desired conical spray pattern of coating material. In accordance with the objectives of this invention, the air deflecting cap does not lie in the path of the powder coating material and, therefore, is not impacted by the powder thus eliminating the problem of wear of this part. In addition, the pressurized air continuously sweeps the nozzle clean of powder preventing the buildup of powder on the front of the gun. Moreover, the air pressure can be remotely controlled by the operator to generate a desired spray pattern. It has been found that the nozzle of the present invention is effective in generating a finely atomized and uniform conical pattern of powder coating material.

Moreover, the nozzle is formed of relatively few simple parts thereby providing manufacturing advantages. It is also easily accessible for maintenance and repair or replacement of parts. Other objects and advantages of the present invention will be apparent from the following detailed description of the invention taken with the accompanying drawings.

Figure 1:
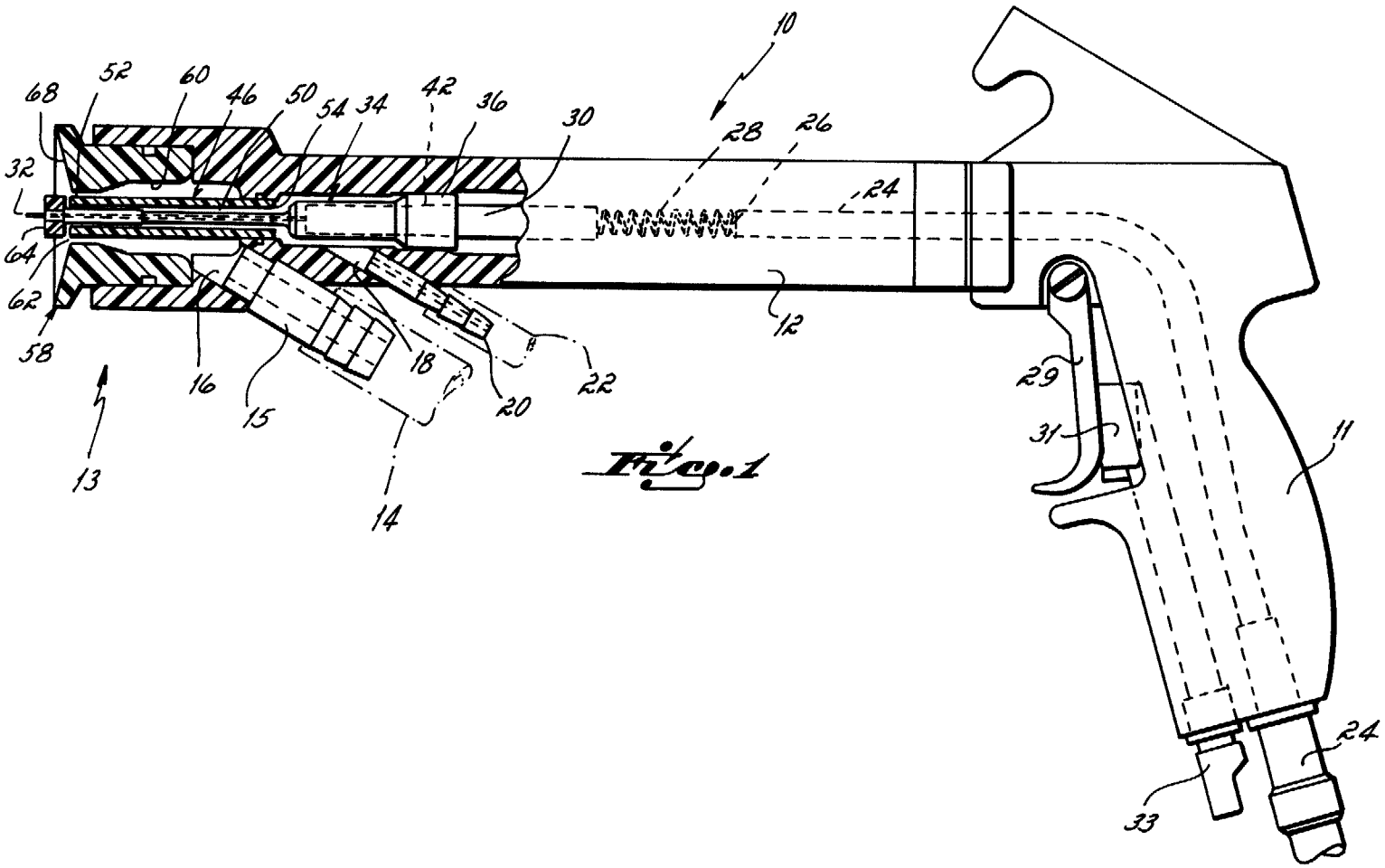
FIG. 1 is a side elevation view with parts in cross-section of the electrostatic powder spray gun of this invention.

The gun 10 illustrated in FIG. 1 of the drawings is an air-operated electrostatic powder spray gun which employs the impact of a pressurized air stream with a stream of fluidized powder coating material to effect atomization of the powder coating material and formation of the material into a desired conical spray pattern.

The gun 10 comprises an electrically grounded metal handle assembly 11, an electrically insulative barrel assembly 12, and an electrically insulative nozzle assembly 13 at the forward end of the barrel 12. Powder coating material is supplied to the gun under pressure from an external reservoir or tank (not shown) through a hose 14. The hose 14 is adapted to be connected to a fitting 15 mounted in an opening 16 through the wall of the barrel 12 of the gun. The powder coating material is fluidized by a pressurized gas such as air and is conveyed through the hose 14 to the gun under pressure. The barrel 12 includes a second opening 18 extending through the wall thereof in which there is mounted a fitting 20 to which an air hose 22 communicating with a source of pressurized air is adapted to be attached.

The handle assembly 11 is made from a metal casting, for example, aluminum, and is electrically grounded. A high voltage source of electrical energy is supplied to the gun 10 by a cable 24 from an external electrical power pack (not shown). The voltage supplied to the gun is typically in the range of 30 to 90 kv. The high voltage cable 24 connects into the butt of the handle 11 and continues through the handle 11 and into the barrel 12. The cable 24 terminates in the barrel in an electrically conductive button 26. An electrically conductive spring 28 is compressed between the button 26 on the end of high voltage cable 24 and a resistor 30. The spring serves to provide an electrical connection between the end of the cable 24 and the resistor 30 and may be embedded in a dielectric grease to prevent arcing. In an actual gun designed for operation at up to 90 kv, the resistor 30 is 175 megohms, but it can be more or less depending on the voltage being supplied through the cable. An electrode 32 is attached at one end to the resistor 30 and the other end extends out of the nozzle assembly 13. The electrode 32 which is connected through the resistor 30 and spring 28 to the high voltage source of electrical energy charges the powder spray coating material being emitted from the nozzle assembly of the gun.

The handle 11 includes a trigger 29 to which is mounted a magnet 31. When the trigger is squeezed, the magnet 31 triggers a proximity switch and connector assembly 33 which extends out of the butt of the handle 11 and connects to a cable to operate controls which turn on and off the electrical power to the gun, the air supply to the powder pump for fluidizing the powder and conveying it to the gun through the hose 14, and the pressurized deflecting air conveyed to the gun through hose 22. However, with regard to the latter, it should be noted that the pressurized deflecting air may be left on to provide a continuous flow of air through the nozzle even when no powder is being supplied to the gun. This continuous flow of air sweeps any residual powder from the nozzle assembly 13 and prevents buildup of powder on the nozzle components. Moreover, a control valve may be provided for regulation of the pressure of the air by the operator. In this manner, the shape of the conical spray of coating material may be varied simply by the operator's varying the air pressure.

Figure 2:
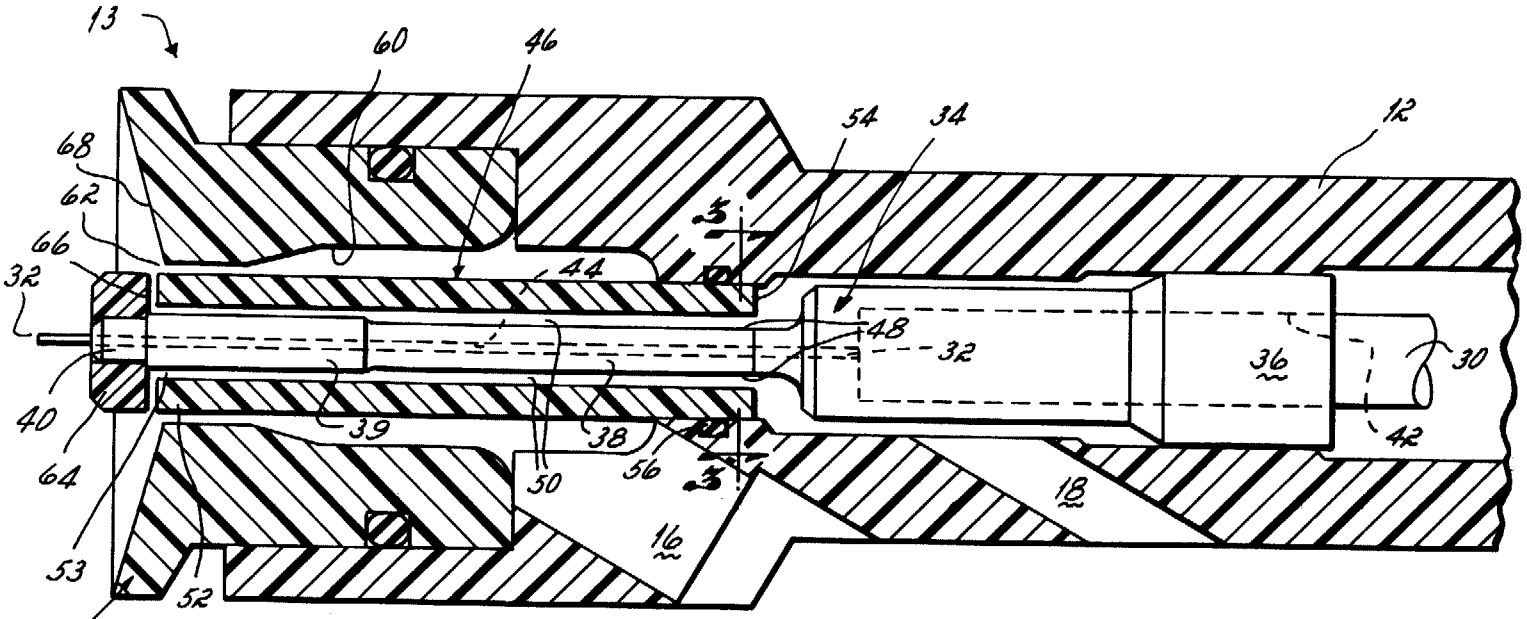
FIG. 2 is a cross-sectional view of the forward end of the electrostatic powder spray gun shown in FIG. 1.

Referring now in addition to FIG. 2, the nozzle assembly 13 includes a tubular support member 34 also formed of an electrically insulative material. The support tube 34 is supported at its rearward end 36 in the barrel 12 of the gun 10 and has at its front end a large diameter portion 38, a smaller diameter portion 39 and a still smaller diameter forwardmost portion 40 all extending forwardly of the rearward end 36. The rearward end 36 includes an internal cavity 42, and an opening 44 extends down the center of the forwardly extending portions 38, 39, 40, the axis of which lies on the center axis of the barrel 12. The resistor 30 slides into the tubular cavity 42 in the rear end 36 of the tube 34, and the charging electrode 32 extends through the opening 44 and out of its forwardmost end 40.

Figure 3:
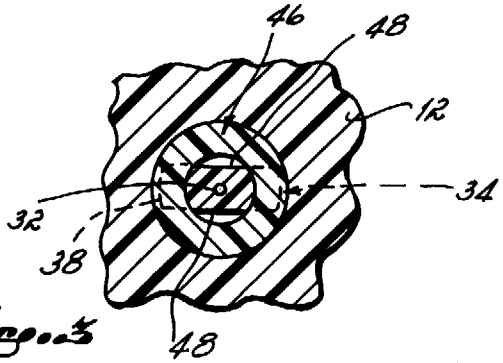
FIG. 3 is a cross-sectional view taken along line 3—3 of FIG. 2.

A tubular sleeve 46 slides on the larger diameter portion 38 of the tube 34 and is supported thereby. As may be seen by referring to FIG. 3, the section 38 of the support tube 34 is provided with a pair of flats 48 on two sides thereof to permit the flow of pressurized air along the sleeve 40 through a passageway 50 defined by the sleeve and the flatten portions 48 and the smaller diameter portion 39 of the support tube 34. As may be seen, this passageway extends along the center of the barrel and nozzle assembly and terminates at an open forward end 52 in the form of an annular gas flow passage 53. The sleeve 46 slides into the barrel at its rearward end 54, and an O-ring seal 56 is provided between the outer surface of the sleeve 40 and the barrel 12 to prevent leakage of pressurized air entering the barrel 12 through the opening 18 in the wall thereof along the outside of the sleeve. In this manner, pressurized air entering the barrel through the opening 18 is directed through the passageway 50 and out the open end 52 of the sleeve 46 in the form of an annular stream of gas under pressure.

A nozzle 58 is mounted in the forward open end of the barrel 12. This nozzle includes a central throughopening 60 through which the forward end 52 of the sleeve passes. The inner surface of the nozzle 58 defines with the outer surface of the sleeve 46, an annular passageway 62 through which fluidized powder coating material entering the nozzle assembly 13 through the opening 16 in the wall of the barrel is emitted from the nozzle. The powder coating material is emitted from the nozzle 58 in the form of an annular flow of material encircling the pressurized air flowing out passageway 53 at the center of the nozzle assembly.

A gas deflector cap 64 is mounted on the forwardmost end 40 of the support tube 34 and is displaced slightly forwardly of the forward open end 52 of the sleeve 46. The deflector cap includes a surface 66 against which the annular stream of pressurized air issuing out of the open end 52 of the sleeve 46 impacts. The deflecting surface 66 changes the direction of this stream of flowing air from one being axially along the center of the nozzle assembly to one which is radially outwardly in a 360° pattern.

Figure 4:
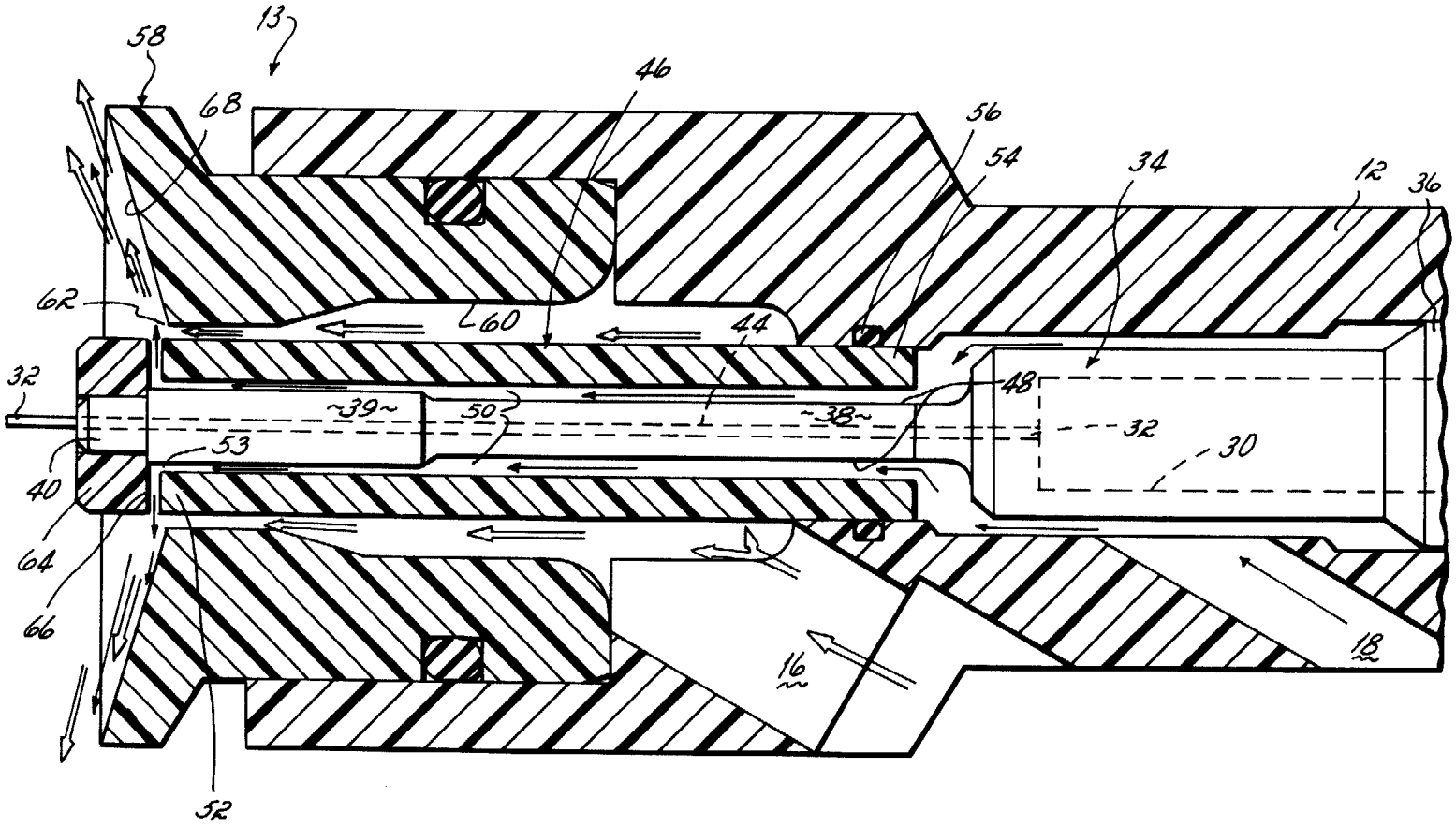
FIG. 4 is an enlarged view of FIG. 2 illustrating the flow paths of the pressurized air and fluidized powder spray coating material in and out of the nozzle shown in FIG. 2.

Referring now to FIG. 4, the flow of pressurized air into and through the nozzle assembly 13 is indicated by the solid arrows while the flow of the coating material is indicated by the open arrows. As may be seen, the pressurized air enters the gun through the opening 18 in the wall of the barrel 12 and is directed through the passageway 50 and out the annular opening 53 in the open end 52 of the sleeve 46. The pressurized air issuing out of the open end 52 impacts the surface 66 of the deflector cap 64 and is thereby turned 90° to a radial outward direction. The coating material enters the nozzle assembly through the opening 16 in the wall of the barrel 12 and flows along the outside of the sleeve 46 and out the annular opening 62. When the coating material which is being conveyed by air under pressure is emitted from the nozzle 58, it is impacted by the outwardly flowing stream of pressurized air and is thereby caused to be finely atomized and a uniform, conical pattern of material results from the impact of the radially outwardly flowing stream of air and the axially flowing stream of powder. The nozzle 58 includes a generally conical surface 68 for directing the outwardly and forwardly moving conical spray of material. The atomized powder is electrically charged by the electrode 32 extending out of the nozzle assembly 13 and past the air deflector cap 64. As may be seen, the outside diameter of the deflector cap 64 is substantially the same as the outside diameter of the sleeve 46. As a result, the cap is not in the stream of moving coating material and is not subject to abrasion from it. Moreover, the powder inside the nozzle assembly 13 flows axially along the outside surface of the sleeve and as a result abrasion on the sleeve is minimized except in the general area where the powder enters the gun at an angle and is turned by the sleeve 46 axially along the sleeve. In any event, if need be, the nozzle may be easily removed from the open end of the barrel merely by sliding it out and the sleeve can be easily removed and replaced merely by sliding the air deflector cap off of the end 40 of the tube 34 and sliding the sleeve 46 off of the portion 38.

As set forth above, the barrel 12 and nozzle assembly 13 are formed of a substantially electrically non-conductive material such as Teflon.

Although the invention has been described in terms of its application to an electrostatic powder spray gun, it will be appreciated that it is equally applicable to powder spray guns which may not employ an electrostatic charging electrode. Moreover, although the invention has been described in terms of the use of air as the deflecting gas, it should be recognized that other gases could be used if desired.

We claim:

1. Apparatus for the coating of an object with a powder spray comprising:

a gas conduit adapted to be connected to a source of pressurized gas to provide a central stream of pressurized gas emitted from said gas conduit, a nozzle surrounding said gas conduit and defining therewith a powder coating material passageway encircling said central stream of pressurized gas, said nozzle being adapted to communicate with a source of fluidized powder coating material under pressure for emitting powder coating material therefrom through said passageway, and deflecting means mounted centrally of said nozzle for deflecting said central stream of pressurized gas to form an outwardly moving stream of pressurized gas, the outer dimension of said deflecting means being no greater than the inner dimension of said coating material passageway where said powder coating material is emitted from said nozzle and said deflecting means being so located with respect to said nozzle that said outwardly moving stream of pressurized gas impacts said powder coating material within the confines of said nozzle to produce a conical spray pattern of said powder coating material issuing from said nozzle.

2. The apparatus of claim 1 wherein said gas conduit comprises a tubular sleeve having open ends wherein said pressurized gas entering said sleeve through one end flows axially along the inside of the sleeve and issues out of the other open end of said sleeve in the form of an annular gas flow pattern and wherein said deflecting means comprises a gas deflector cap spaced from the said other open end of said sleeve, said cap having a generally planar face facing said other open end of said sleeve and being operative to direct said pessurized gas radially outwardly and into the flow of powder coating material emitted from said nozzle.

3. The apparatus of claim 2 further comprising a charging electrode central to said deflecting means for imparting an electrostatic charge to said powder.

4. In an electrostatic powder spray coating gun including a barrel having an open forward end from which powder coating material is emitted and is electrically charged, a first passage through the wall thereof adapted to be connected to a source of fluidized powder coating material to be emitted from the gun, a second passage through the wall thereof adapted to be connected to a source of gas under pressure, and a high voltage electrical path therein adapted to be connected to a source of high voltage electrical power, the improvement comprising a nozzle assembly comprising:

a support tube mounted generally axially in said barrel and having a forward end extending out of the open forward end of the barrel, a sleeve surrounding said support tube and defining therewith a generally central axial gas flow passageway, said gas flow passageway communicating with said second passage through the wall of said barrel, said sleeve terminating in an open end at said open forward end of said barrel from which pressurized gas issues, a nozzle mounted in the open forward end of said barrel and surrounding at least a portion of said sleeve and defining therewith a generally annular powder coating material passageway encircling said gas flow passageway through which powder coating material is emitted, said powder coating material passageway communicating with said first passage through the wall of said barrel, a gas deflector cap mounted on the forward end of said support tube having a planar deflecting surface spaced from said open end of said sleeve for deflecting said pressurized gas issuing out of said open end of said sleeve radially outwardly, the outer dimension of said gas deflector cap being no greater than the inner dimension of said coating material passageway where said powder coating material is emitted from said nozzle and said gas deflector cap being so located with respect to said nozzle that said radially outwardly moving stream of pressurized gas impacts said powder coating material within the confines of said nozzle to produce a conical spray pattern of powder coating material issuing from said nozzle, and a charging electrode in said support tube having one end extending out the forward end thereof and beyond said gas deflector cap and the other end thereof connected to said high voltage electrical path.

5. The nozzle assembly of claim 4 wherein said sleeve is supported by a portion of said support tube having a pair of flats on the surface thereof to permit the flow of pressurized gas into and along said sleeve.

6. The gun of claim 4 further including means for controlling the flow of said pressurized gas through said nozzle assembly independently of the flow of powder coating material therethrough such that said gas can sweep said nozzle assembly clean of said powder after supply of said powder to said nozzle assembly has been stopped.

* * * * *